US005230644A

United States Patent [19]

Meisenburg et al.

[11] Patent Number: 5,230,644

[45] Date of Patent: Jul. 27, 1993

[54] COUNTER-ROTATING SURFACING MARINE DRIVE

[75] Inventors: Gary L. Meisenburg; Edward C. Eick; Phillip D. Magee; Charles M. Mixon, all of Stillwater, Okla.; Robert B. Weronke, Oshkosh, Wis.

[73] Assignee: Brunswick Corporation, Skokie, Ill.

[21] Appl. No.: 889,495

[22] Filed: May 27, 1992

[51] Int. Cl.[5] ..... B63H 5/06

[52] U.S. Cl. ..... 440/80; 440/79

[58] Field of Search ..... 440/75, 76, 78, 80, 440/81, 83, 900; 74/376, 378, 379, 416, 423; 192/21

[56] References Cited

U.S. PATENT DOCUMENTS

| | | | |
|---|---|---|---|
| 4,630,719 | 12/1986 | McCormick | 440/83 |
| 4,679,682 | 7/1987 | Gray, Jr. et al. | 192/21 |
| 4,764,135 | 8/1988 | McCormick | 440/78 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,869,121 | 9/1989 | Meisenburg | 74/323 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 192/21 |

*Primary Examiner*—Edwin L. Swinehart

*Attorney, Agent, or Firm*—Andrus, Sceales, Starke & Sawall

[57] ABSTRACT

A marine drive (10) has two counter-rotating surface operating propellers (12 and 14). An upper adaptor spool (48) has a lower threaded outer portion (50) mating with a threaded portion (46) of the vertical bore (26) of the drive housing (20) and supporting the upper gear (42) for rotation about the driveshaft (36) and supporting the driveshaft (36) for rotation within the adaptor spool (48). Vertical bore structure enables assembly from above of the majority of the vertical drive train components into a one-piece unitary integrally cast housing. The vertical distance between the adaptor spool (48) and the lower bearing (118) supporting the vertical driveshaft (36) is about equal to propeller radius. The lower concentric counter-rotating propeller shafts (156, 158) are spaced from the upper input shaft (28) by a distance along the driveshaft (36) in the range of about 9 to 15 inches.

15 Claims, 3 Drawing Sheets

COUNTER-ROTATING SURFACING MARINE DRIVE

BACKGROUND AND SUMMARY

The invention relates to a marine drive having two counter-rotating surface operating propellers.

The present invention arose during development efforts directed toward a marine drive enabling increased top end boat speed. This is achieved by raising the torpedo out of the water to reduce drag, and by using two counter-rotating surface operating propellers. Reducing torpedo drag by raising the torpedo above the surface of the water is known in the art, for example U.S. Pat. No. 4,871,334, column 3, lines 35+.

The present invention provides structure in the vertical portion of the drive permitting the noted raising of the torpedo without raising the transom mounting location for the drive.

In one aspect of the invention, an upper adaptor spool is provided at the top of the vertical bore of the drive unit and supports both the vertical driveshaft and the upper input gear.

In another aspect, structure is provided enabling assembly of the majority of the vertical drive train from above into the vertical bore of the drive housing.

In another aspect, the invention enables reduction of the vertical distance between the upper adaptor spool and the lower driveshaft bearing to be about equal to propeller radius.

In another aspect, the invention enables a onepiece unitary integrally cast housing, wherein in the preferred embodiment, the distance along the driveshaft between the lower concentric counter-rotating propeller shafts and the upper input shaft is in the range of about 9 to 15 inches.

DETAILED DESCRIPTION

Figure 1:
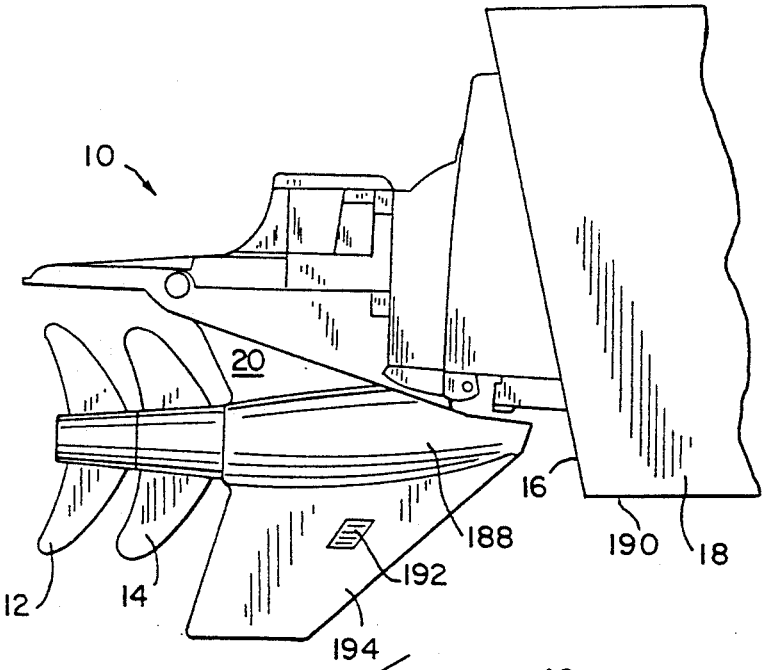
FIG. 1 is a side elevation view of a marine drive in accordance with the invention.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
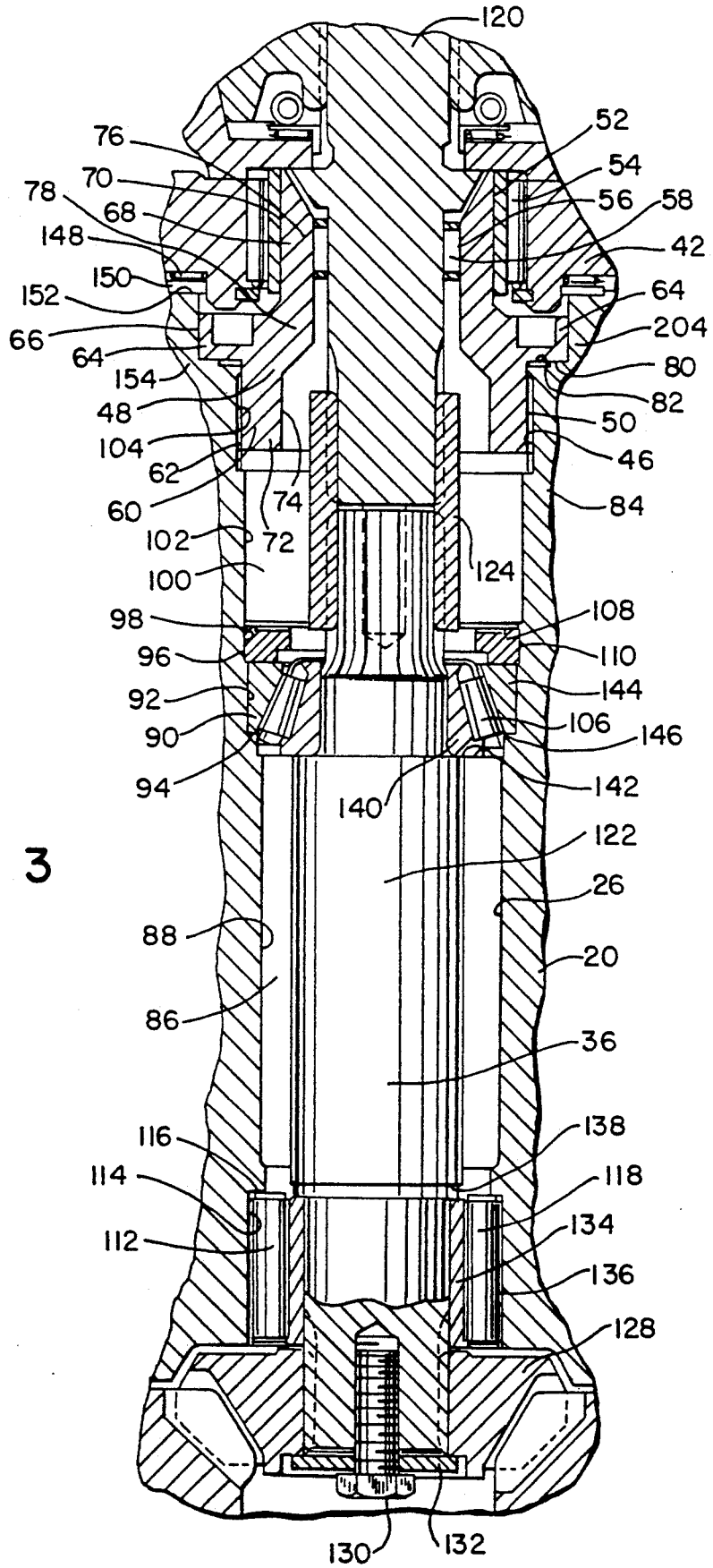
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports driveshaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Figure 4:
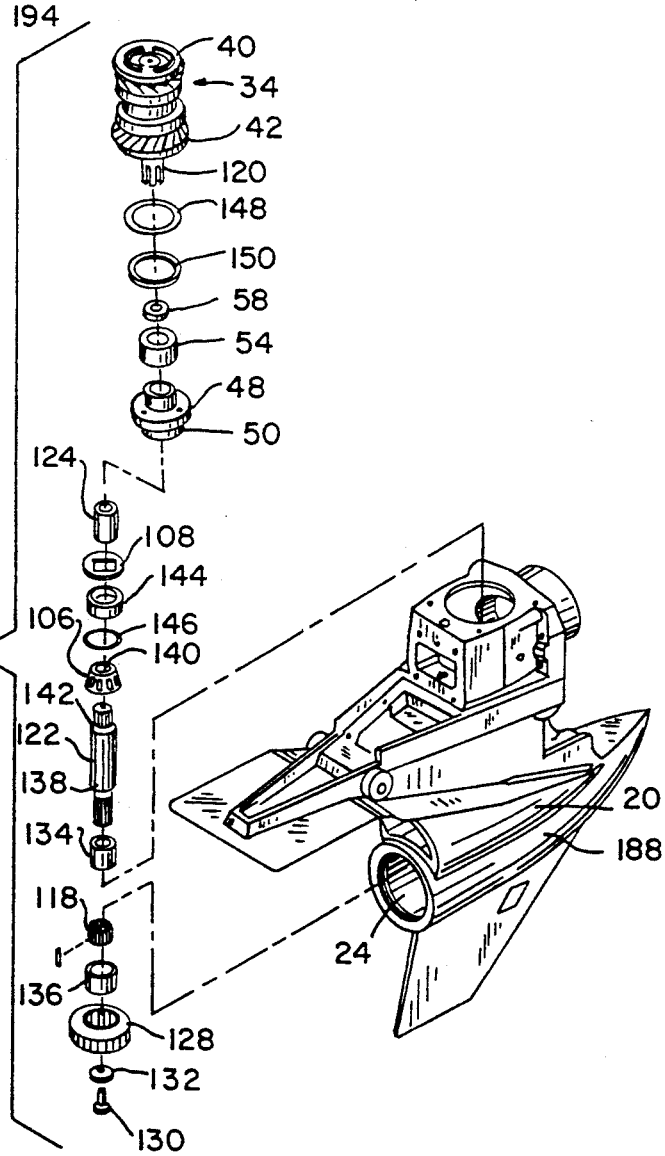
FIG. 4 is an exploded perspective view of a portion of the structure of FIG. 1.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122 Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
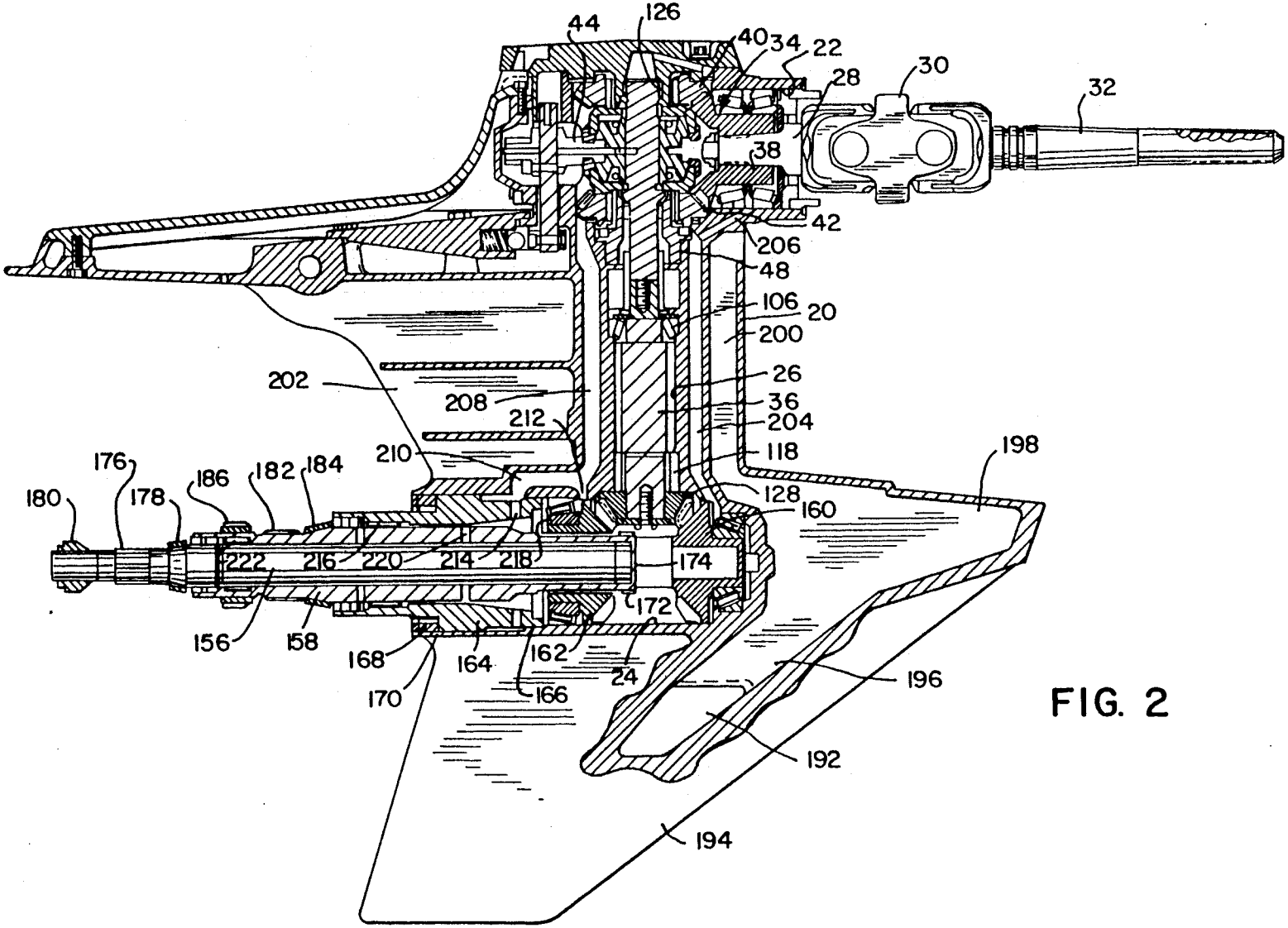
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to commonly owned co-pending application Ser. No. 07/889,530, filed on even date herewith, entitled "Marine Drive Having Two Counter-rotating Surfacing Propellers And Dual Propeller Shaft Assembly". The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without raising the engine in the boat nor the usual transom mounting location for the drive. Housing 20 is a one-piece unitary integrally cast housing replacing prior two piece housings. Propeller shafts 156, 158 are spaced from upper input shaft 28 by a distance along driveshaft 36 in the range of about 9 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

It is recognized that various equivalents, alternatives and modifications are possible within the scope of the appended claims.

We claim:

1. A marine drive having two counter-rotating surface operating propellers comprising:

a housing having upper and lower spaced horizontal bores and an intersecting vertical bore extending therebetween, said vertical bore having an upper threaded portion below said upper horizontal bore;

an upper input shaft in said housing;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

an upper gear in said housing and operatively connected between said input shaft and said driveshaft; and an upper adaptor spool having a threaded portion mating with said upper threaded portion of said vertical bore in thread mounted relation and supporting said upper gear for rotation about said driveshaft.

2. The apparatus defined in claim I wherein said adaptor spool has an upper outer surface supporting an upper outer bearing which supports said upper gear for rotation about said adaptor spool, and said adaptor spool has an upper inner surface supporting an upper inner bearing which supports said driveshaft for rotation in said adaptor spool.

3. The apparatus defined in claim 1 wherein said adaptor spool has a lower threaded outer portion mating with said threaded portion of said vertical bore.

4. A marine drive having two counter-rotating surface operating propellers comprising:

a housing having upper and lower spaced horizontal bores and an intersecting vertical bore extending therebetween, said vertical bore having an upper threaded portion;

an upper input shaft in said housing;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

an upper gear in said housing and operatively connected between said input shaft and said driveshaft; and an upper adaptor spool having a threaded portion mating with said upper threaded portion of said vertical bore in thread mounted relation and supporting said upper gear for rotation about said driveshaft, wherein:

said adaptor spool has a lower outer section of a first outer diameter and threaded and mating with said upper threaded portion of said vertical bore;

said adaptor spool has a center outer section above said lower outer section and of a central outer diameter larger than said lower outer diameter;

said adaptor spool has an upper outer section above said lower outer section and of an upper outer diameter less than said central outer diameter and less than said lower outer diameter;

said adaptor spool has a lower inner section of a lower inner diameter within said vertical bore;

said adaptor spool has a lower inner section above said lower inner section and of an upper inner diameter less than said lower inner diameter;

and comprising:

an upper outer bearing between said upper gear and said upper outer section of said adaptor spool and supporting said upper gear for rotation about said adaptor spool; and an upper inner bearing between said driveshaft and said upper inner section of said adaptor spool and supporting said driveshaft for rotation in said adaptor spool.

5. The apparatus defined in claim 4 wherein:

said vertical bore is defined by a sidewall having an upper end; and said lower section and said central outer section of said adaptor spool meet at a downwardly facing annular shoulder at said upper end of said sidewall.

6. The invention defined in claim 4 wherein said upper outer diameter is substantially equal to said lower inner diameter.

7. A marine drive having two counter-rotating surface operating propellers comprising:

a housing having upper and lower spaced horizontal bores and an intersecting vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said vertical bore having a first section of a first inner diameter;

said vertical bore having a second section above said first section and of a second inner diameter larger than said first inner diameter;

said first and second sections meeting at an upwardly facing annular shoulder;

said vertical bore having a first thread above said second section and of an inner diameter at least as great as said second inner diameter;

said vertical bore having a third section above said first thread and of a third inner diameter greater than said second inner diameter; and said vertical bore having a second thread above said third section and of an inner diameter at least as great as said third inner diameter.

8. The invention defined in claim 7 comprising:

a central bearing seated against said shoulder of said vertical bore and supporting said driveshaft for rotation; and an annular ring having a threaded outer portion mating with said first thread of said vertical bore and retaining said central bearing against said shoulder of said vertical bore.

9. The apparatus defined in claim 8 comprising:

an upper bearing supporting said driveshaft for rotation; and an adaptor spool having a threaded outer portion mating with said second thread of said vertical bore and retaining said upper bearing to support said driveshaft for rotation.

10. The apparatus defined in claim 9 wherein:

said vertical bore has a fourth section below said first section and of a fourth inner diameter larger than said first inner diameter;

said first and fourth sections meet at a downwardly facing annular shoulder;

and comprising a lower bearing seated against said downwardly facing shoulder of said vertical bore and supporting said driveshaft for rotation, wherein:

said central and upper bearings are insertable into said vertical bore from above; and said lower bearing is insertable into said vertical bore from below.

11. The apparatus defined in claim 10 wherein:

said driveshaft comprises a two piece member comprising an upper driveshaft segment and a lower driveshaft segment coupled by a sleeve;

said central bearing and said lower bearing support said lower driveshaft segment; and said upper bearing supports said upper driveshaft segment.

12. A marine drive having two counter-rotating surface operating propellers comprising:

a housing having upper and lower spaced horizontal bores and an intersecting vertical bore extending therebetween;

an upper input shaft in said upper horizontal bore;

a downwardly extending driveshaft in said vertical bore and driven by said input shaft;

an upper gearing said housing and operatively connected between said input shaft and said driveshaft;

a pair of lower concentric counter-rotating propeller shafts in said lower horizontal bore and driven by said driveshaft;

a lower gear in said housing and operatively connected between said driveshaft and said propeller shafts;

a pair of counter-rotating surface operating propellers each mounted to a respective one of said propeller shafts;

a lower bearing at the bottom of said vertical bore and supporting said driveshaft for rotation; and an adaptor spool at the intersection of the top of said vertical bore and the bottom of said upper horizontal bore and supporting said driveshaft for rotation, wherein the vertical distance between said adaptor spool and said lower bearing is about equal to propeller radius.

13. The invention defined in claim 12 wherein said adaptor spool has a lower section extending downwardly into said vertical bore, and has an upper section extending upwardly into said upper horizontal bore.

14. A marine drive having two counter-rotating surface operating propellers comprising:

a one-piece unitary integrally cast housing having upper and lower spaced horizontal bores and an intersecting vertical bore extending therebetween, said vertical bore having an upper threaded portion below said upper horizontal bore;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

an upper gear in said housing and operatively connected between said input shaft and said driveshaft;

an adaptor spool at the intersection of the top of said vertical bore and the bottom of said upper horizontal bore, said adaptor spool having a threaded portion extending downwardly into said vertical bore below said upper horizontal bore and mating with said upper threaded portion of said vertical bore in thread mounted relation and supporting said upper gear for rotation about said driveshaft.

15. The invention defined in claim 14 wherein said lower concentric counter-rotating propeller shafts are spaced from said upper input shaft by a distance along said driveshaft in the range of about 9 to 15 inches.

* * * * *

UNITED STATES PATENT AND TRADEMARK OFFICE

CERTIFICATE OF CORRECTION

PATENT NO. : 5,230,644

DATED : July 27, 1993

INVENTOR(S) : GARY L. MEISENBURG ET AL

It is certified that error appears in the above-identified patent and that said Letters Patent is hereby corrected as shown below:

Claim 4, Col. 5, Line 17, delete "center" and substitute therefor -- central --; Claim 4, Col. 5, Line 20, delete "lower" and substitute therefor -- central --; Claim 4, Col. 5, Line 25, delete "a lower" and substitute therefor -- an upper --; Claim 12, Col. 6, Line 56, delete "gearing" and substitute therefor -- gear in --.

Signed and Sealed this

Fifth Day of July, 1994

Bruce Lehman

*Attest:*

BRUCE LEHMAN

*Attesting Officer*

*Commissioner of Patents and Trademarks*